US012420132B2

(12) United States Patent
Ren

(10) Patent No.: US 12,420,132 B2
(45) Date of Patent: Sep. 23, 2025

(54) PULL ROPE CONNECTING DEVICE AND FITNESS ACCESSORY

(71) Applicant: Xiamen Renhe Sports Equipment Co., Ltd., Fujian (CN)

(72) Inventor: Yangjie Ren, Fujian (CN)

(73) Assignee: Xiamen Renhe Sports Equipment Co., Ltd., Fujian (CN)

( * ) Notice: Subject to any disclaimer, the term of this patent is extended or adjusted under 35 U.S.C. 154(b) by 115 days.

(21) Appl. No.: 18/434,728

(22) Filed: Feb. 6, 2024

(65) Prior Publication Data

US 2025/0195935 A1 Jun. 19, 2025

(30) Foreign Application Priority Data

Dec. 19, 2023 (CN) ..... 202323473474.1

(51) Int. Cl.
*A63B 21/055* (2006.01)
*A63B 21/00* (2006.01)

(52) U.S. Cl.
CPC ..... *A63B 21/055* (2013.01); *A63B 21/4033* (2015.10)

(58) Field of Classification Search
CPC ..... A63B 21/0557; A63B 21/4033; A63B 21/4035; A63B 21/06; A63B 21/0608; A63B 21/0618; A63B 21/0726; A63B 21/075
See application file for complete search history.

(56) References Cited

U.S. PATENT DOCUMENTS

| | | | | |
|---|---|---|---|---|
| 11,590,384 | B2 * | 2/2023 | Hurlbut | A63B 23/03508 |
| 12,005,292 | B1 * | 6/2024 | Smith, Jr. | A63B 21/0728 |
| 12,186,619 | B1 * | 1/2025 | Smith, Jr. | A63B 21/04 |
| 2014/0323275 | A1 * | 10/2014 | Moses | A63B 21/1627 482/40 |
| 2020/0188723 | A1 * | 6/2020 | Reibman | A63B 21/0724 |

* cited by examiner

*Primary Examiner* — Zachary T Moore

(74) *Attorney, Agent, or Firm* — JCIPRNET

(57) ABSTRACT

The present disclosure relates to a pull rope connecting device and a fitness accessory. The pull rope connecting device slidably sleeves a pull bar; the pull bar is provided with a guide slot and a plurality of location holes; the pull rope connecting device is provided with a connecting part, a guide block, and a positioning column; the guide block is slidably plugged into the guide slot; the positioning column is movably arranged and can be plugged into or removed from the location holes. When the pull rope connecting device slides to an adjusted connection position, according to the cooperation between the guide block and the guide slot, an angle of the pull rope connecting device does not need to be adjusted by rotation, which makes it more convenient to align the positioning column with the corresponding location hole.

10 Claims, 4 Drawing Sheets

PULL ROPE CONNECTING DEVICE AND FITNESS ACCESSORY

CROSS-REFERENCE TO RELATED APPLICATION

This application claims the priority benefit of Chinese application serial no. 202323473474.1, filed on Dec. 19, 2023. The entirety of the above-mentioned patent application is hereby incorporated by reference herein and made a part of this specification.

BACKGROUND

Technical Field

The present disclosure relates to the field of fitness equipment, and in particular, to a pull rope connecting device and a fitness accessory.

Description of Related Art

At present, many sets of fitness equipments for strength exercise include pull bars. When a user performs strength exercise, the user holds the pull bar and pulls it to drive a pull rope, so as to provide a resistance to a motor connected to the pull rope, achieving an effect of strength exercise.

Chinese patent No. CN218961688U provides a pull rope connecting device. The pull rope connecting device sleeves a pull bar, and the pull bar is provided with a plurality of plugging holes spaced from one another. The pull rope connecting device includes a ringlike main body and an elastic plug; the elastic plug includes a sliding block and an elastic member; the sliding block is slidably arranged on the ringlike main body, and a plugging column is arranged on an inner side of the sliding block; the elastic member is in contact with the sliding block and the ringlike main body respectively; and the elastic member is configured to drive the plugging column to be plugged into the plugging hole, so as to lock the pull rope connecting device on the pull bar. When a connection position between the pull rope and the pull bar needs to be adjusted, the plugging column is pulled outwards and removed from the plugging hole, and then the pull rope connecting device is moved to align the plugging column and plug it into the plugging holes at different positions. However, as the degree of freedom of the pull rope connecting device in a circumferential direction of the pull bar is not limited, the pull rope connecting device easily rotates during movement, making it difficult to align the plugging column with the plugging hole. The pull rope connecting device needs to be rotated to an angle that allows the plugging column to be plugged into the plugging hole, and it is inconvenient to adjust the connection position.

SUMMARY

The present disclosure aims to provide a pull rope connecting device and a fitness accessory. The pull rope connecting device is more convenient to adjust a connection position between the pull rope connecting device and a pull bar.

In order to solve the above technical problems, the present disclosure adopts following technical solutions.

The present disclosure provides a pull rope connecting device, wherein the pull rope connecting device is configured to slidably sleeve a pull bar; the pull bar is provided with a guide slot and a plurality of location holes that the guide slot and location holes are connected; the plurality of location holes are arranged at intervals in an extension direction of the guide slot; the pull rope connecting device is provided with a connecting part, a guide block, and a positioning column; the connecting part is configured to be connected to a pull rope; the guide block is slidably plugged into the guide slot to limit rotation of the pull rope connecting device relative to the pull bar; the positioning column is movably arranged; and the positioning column can be plugged into or removed from the location holes.

In some embodiments of the present disclosure, the location holes extend in a circumferential direction of the pull bar; and the positioning column is rotatably arranged.

In some embodiments of the present disclosure, the pull rope connecting device comprises a main body, a rotating ring, and an elastic member; the main body is provided with the guide block; the rotating ring rotatably sleeves the main body, and the positioning column is arranged on the rotating ring; a first end of the elastic member is fixed to the main body; a second end of the elastic member is fixed to the rotating ring; and the elastic member drives the rotating ring to be rotatably plugged into the location hole.

In some embodiments of the present disclosure, the main body is provided with a through hole and a mounting slot; the through hole penetrates through the main body; the mounting slot is arranged on an outer surface of the main body and is connected to the through hole; the rotating ring covers at an outer side of the mounting slot, and the positioning column is plugged into the through hole; the elastic member is arranged in the mounting slot, and the second end of the elastic member is fixed to the positioning column.

In some embodiments of the present disclosure, a fixed block is also arranged on the main body; the fixed block is arranged inside the mounting slot, then the mounting slot is divided into a first mounting slot and a second mounting slot; the fixed block is provided with a perforation; the perforation penetrates through the fixed block and connects the first mounting slot with the second mounting slot; the perforation comprises a first perforation and a second perforation; the elastic member is an elastic ring; the first end of the elastic ring is arranged in the first perforation and the second perforation in a penetrating manner; and the second end of the elastic ring sleeves the positioning column.

In some embodiments of the present disclosure, a notch is arranged on the positioning column; and the second end of the elastic ring is embedded into the notch.

In some embodiments of the present disclosure, the pull rope connecting device further comprises a connecting ring and a retaining ring; the main body is further provided with a step ring; the step ring is arranged on the outer surface of the main body; the rotating ring is arranged on one side of the step ring; the connecting ring rotatably sleeves the main body and is arranged on the side of the rotating ring which faces away from the step ring; the connecting ring is provided with the connecting part; the retaining ring sleeves the main body and is arranged on the side of the connecting ring which faces away from the rotating ring; and the retaining ring is fixedly connected to the main body.

The present disclosure further provides a fitness accessory, including: a pull bar, being provided with a guide slot and a plurality of location holes that the guide slot and location holes are connected, wherein the plurality of location holes are arranged at intervals in an extension direction of the guide slot; a pull rope connecting device, slidably sleeving the pull bar, wherein the pull rope connecting device is provided with a connecting part, a guide block, and a positioning column; the connecting part is configured to be connected to a pull rope; the guide block is slidably plugged into the guide slot; the positioning column is movably arranged; and the positioning column can be plugged into or removed from the location holes.

In some embodiments of the present disclosure, a region, which is provided with the guide slot and the location holes on the pull bar, is named as the adjustment region; the pull bar comprises two adjustment regions, and the two adjustment regions are respectively located at two ends of the pull bar; the fitness accessory includes two pull rope connecting devices which slidably sleeve the two adjustment regions respectively.

In some embodiments of the present disclosure, the guide slot is linear and extends in an axial direction of the pull bar.

Through the above technical solutions, it can be found that the embodiments of the present disclosure have at least the following advantages and beneficial effects:

In the pull rope connecting device provided by the embodiments of the present disclosure, when the positioning column is removed from the location hole, the pull rope connecting device can slide on the pull bar to adjust a connection position between the pull rope connecting device and the pull bar. Furthermore, in the sliding process of the pull rope connecting device, the guide block of the pull rope connecting device slides in the guide slot; the cooperation between the guide block and the guide slot limits the rotation of the pull rope connecting device relative to the pull bar, and the arrangement positions of the plurality of location holes in the extension direction of the guide slot are fixed. When the pull rope connecting device slides to an adjusted connection position, automatic quick alignment can be achieved under the action of the elastic member, and an angle of the pull rope connecting device does not need to be adjusted by rotation, which makes it more convenient to align the positioning column with the corresponding location hole on the adjusted connection position; and the positioning column is plugged into the corresponding location hole to lock the pull rope connecting device.

BRIEF DESCRIPTION OF THE DRAWINGS

By considering the following detailed explanations of the preferred implementations of the present disclosure in conjunction with the accompanying drawings, various objectives, features, and advantages of the present disclosure will become more apparent. The accompanying diagrams are only exemplary illustrations of the present disclosure and may not necessarily be drawn to scale. In the accompanying drawings, identical reference numerals represent identical or similar components. Where.

Figure 1:
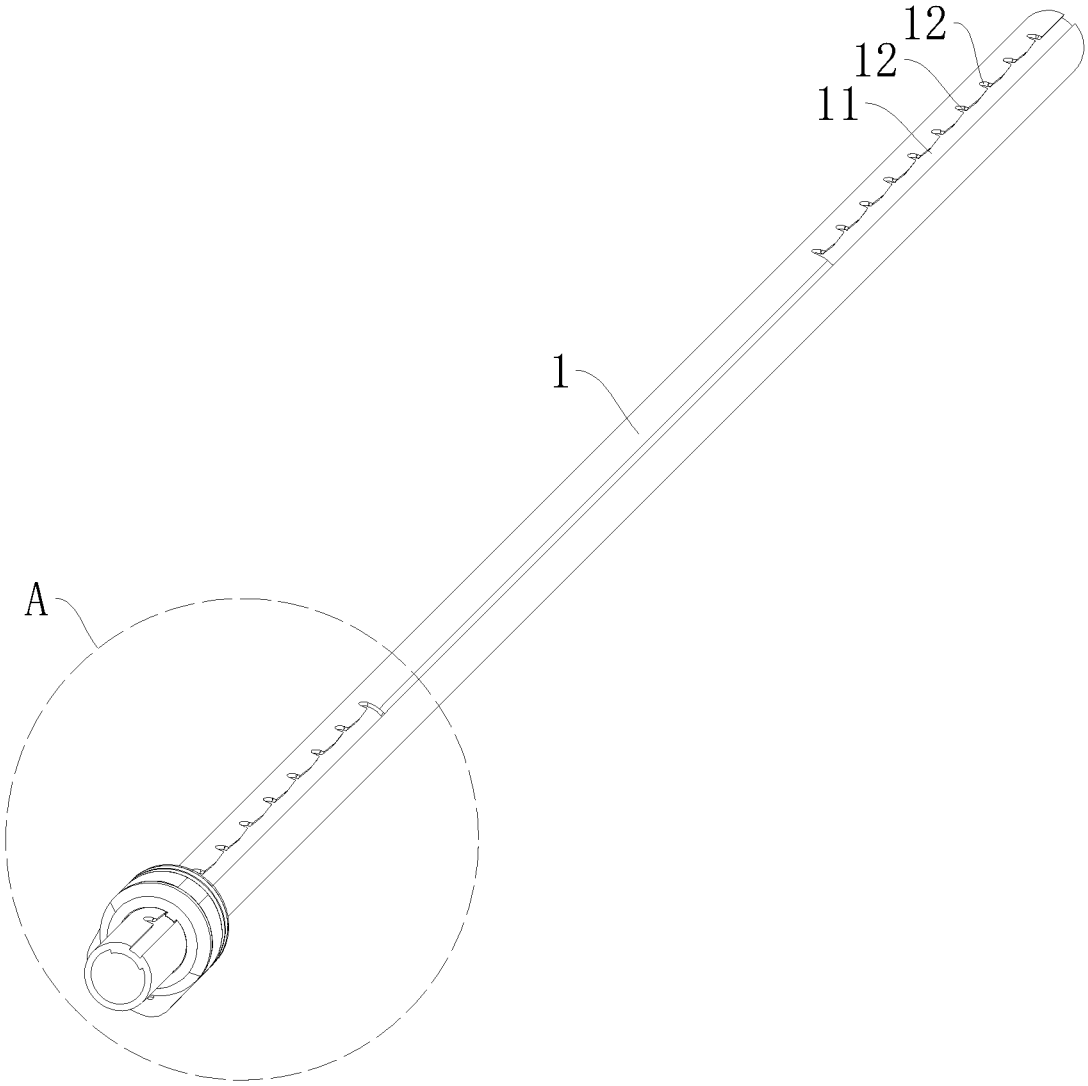
FIG. 1 is a schematic structural diagram of a fitness accessory according to an embodiment of the present disclosure.
Figure 2:
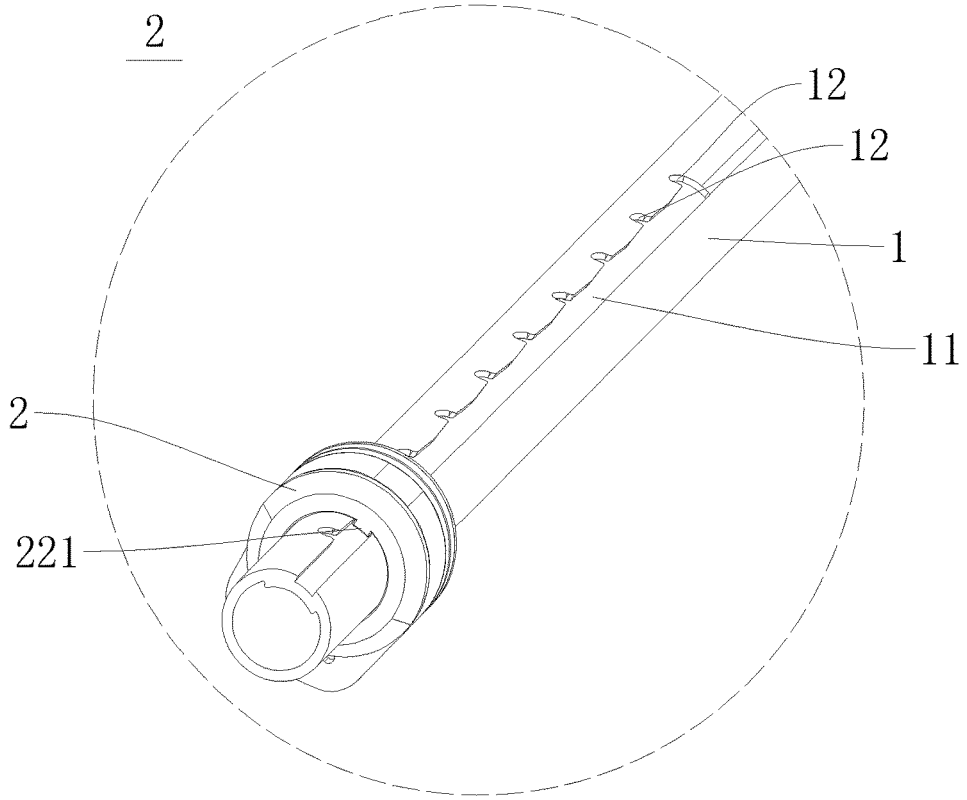
FIG. 2 is an enlarged diagram of a region A in FIG. 1.

Reference numerals in the drawings are as follows: 1: pull bar; 11: guide slot; 12: location hole; 2: pull rope connecting device; 21: connecting ring; 211: extension part; 2111: connecting part; 22: main body; 221: guide block; 222: through hole; 223: mounting slot; 2231: first mounting slot; 2232: second mounting slot; 224: positioning column; 2241: perforation; 225: step ring; 23: rotating ring; 231: positioning column; 2311: notch; 24: retaining ring; 241: connecting slot; 242: limiting strip; and 25: decorative ring.

DESCRIPTION OF THE EMBODIMENTS

Although the present disclosure can be easily manifested in different forms of embodiments, only some specific embodiments are shown in the accompanying drawings and will be explained in detail in this specification. Meanwhile, it can be understood that this specification should be regarded as an exemplary explanation of the principles of the present disclosure, rather than being intended to limit the present disclosure to what is explained here.

Therefore, a feature pointed out in this specification will be used to explain one of the features from an embodiment in the present disclosure, rather than implying that each embodiment of the present disclosure needs to have the described feature. Furthermore, it should be noted that this specification describes many features. Although some features can be combined to demonstrate possible system designs, these features can also be used for other combinations which are not explicitly stated. Therefore, unless otherwise specified, the combination described is not intended for limitation.

In the embodiments shown in the drawings, directional indications (such as up, down, left, right, front, and back) are used to explain that the structures and motions of various components in the present disclosure are not absolute but relative. When these components are in positions shown in the accompanying drawings, these explanations are appropriate. If the explanations for the positions of these components change, the indications for these directions also change correspondingly.

Referring to FIG. 1 to FIG. 4, a fitness accessory provided by an embodiment of the present disclosure includes a pull bar 1 and a pull rope connecting device 2.

The pull bar 1 is provided with a guide slot 11 and a plurality of location holes 12 that the guide slot 11 and location holes 12 are connected. And the plurality of location holes 12 are arranged at intervals in an extension direction of the guide slot 11.

The pull rope connecting device 2 is provided with a connecting part 2111, a guide block 221, and a positioning column 231; the connecting part 2111 is configured to be connected to a pull rope; the guide block 221 is slidably plugged into the guide slot 11 to limit rotation of the pull rope connecting device 2 relative to the pull bar 1; the positioning column 231 is movably arranged; and the positioning column 231 can be plugged into or removed from the location holes 12.

Through the above structural design, when the positioning column 231 is removed from the location hole 12, the pull rope connecting device 2 can slide on the pull bar 1 to adjust a connection position between the pull rope connecting device 2 and the pull bar 1. Furthermore, in a sliding process mentioned above, the guide block 221 of the pull rope connecting device 2 slides in the guide slot 11; the cooperation between the guide block 221 and the guide slot 11 limits the rotation of the pull rope connecting device 2 relative to the pull bar 1, and the arrangement positions of the plurality of location holes 12 in the extension direction of the guide slot 11 are fixed. When the pull rope connecting device 2 slides to an adjusted connection position, automatic quick alignment can be achieved under the action of an elastic member, and an angle of the pull rope connecting device 2 does not need to be adjusted by rotation, which makes it more convenient to align the positioning column 231 with the corresponding location hole 12 on the adjusted connection position; and the positioning column 231 is plugged into the corresponding location hole 12 to lock the pull rope connecting device 2.

A region, which is provided with the guide slot 11 and the location holes 12 on the pull bar 1 is named as the adjustment region. The pull bar 1 includes two adjustment regions, and the two adjustment regions are respectively located at two ends of the pull bar 1. There are two groups of pull rope connecting devices 2 which slidably sleeve the two adjustment regions respectively. When any pull rope connecting device 2 slides on pull bar 1, a distance between the two pull rope connecting devices 2 can be adjusted to adapt to users with different shoulder widths, so as to ensure the exercise effect.

In other embodiments, the fitness accessory can also be provided with only one pull rope connecting device 2. The connecting part 2111 configured to be connected to the pull rope on the pull rope connecting device 2 is a mobile connecting part 2111, and a fixed connecting part 2111 is arranged on the pull bar 1. When the pull rope connecting device 2 slides, a distance between the mobile connecting part 2111 and the fixed connecting part 2111 can be adjusted to adapt to the users with different shoulder widths.

The guide slot 11 is linear and extends in an axial direction of the pull bar 1. When the pull rope connecting device 2 slides, the distance between the two pull rope connecting devices 2 can be quickly adjusted. In other embodiments, the guide slot 11 can also be arc-shaped or threaded.

The pull bar 1 is linear. In other embodiments, the pull bar 1 can also be curved.

The location holes 12 extend in a circumferential direction of the pull bar 1, and the positioning column 231 can be rotatably arranged. A rotation direction of the positioning column 231 is the circumferential direction of the pull bar 1. The positioning column 231 is rotated to be plugged into or removed from the location holes 12. For example, when the positioning column 231 is clockwise rotated to be plugged into the location holes 12, and then the positioning column 231 is anticlockwise rotated to be removed from the location holes 12.

In other embodiments, the location holes 12 extend in a radial direction of the pull bar 1, and the location holes 12 are concavely formed in a bottom surface of the guide slot 11. The positioning column 231 is movably arranged. A movement direction of the positioning column 231 is the radial direction of the pull bar 1. The positioning column 231 is pushed inwards to be plugged into the location holes 12, and the positioning column 231 is pulled outwards to be removed from the location holes 12.

Figure 3:
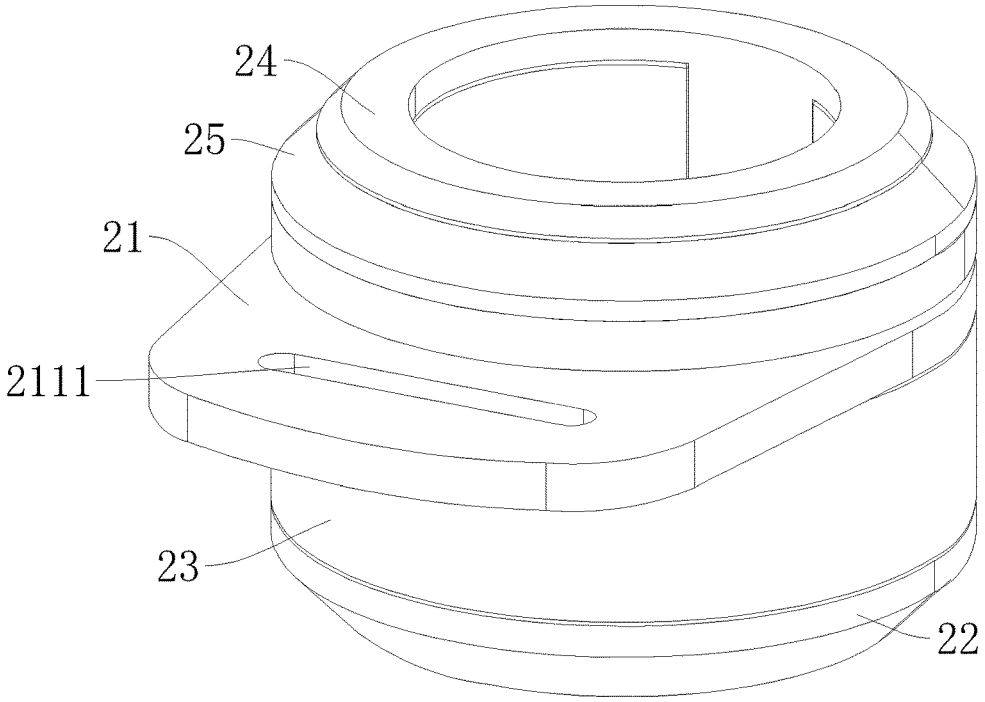
FIG. 3 is a schematic structural diagram of a pull rope connecting device in FIG. 2.
Figure 4:
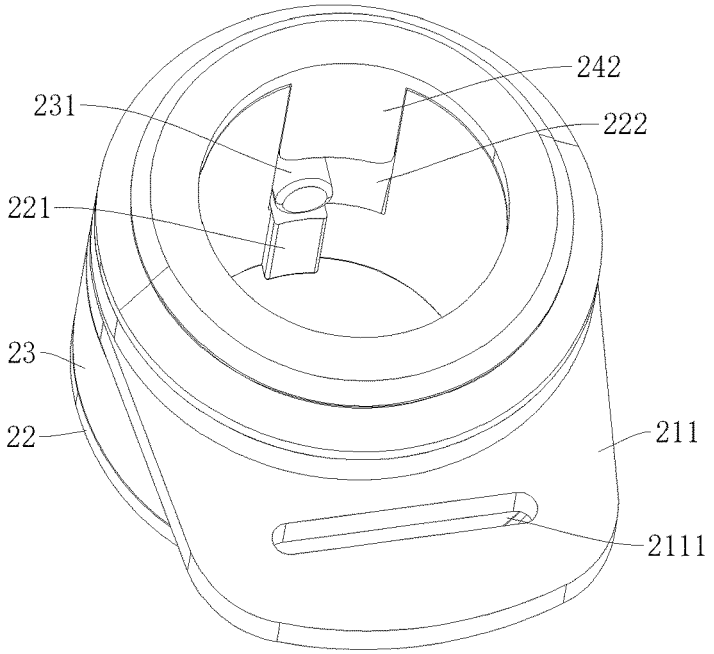
FIG. 4 is a schematic structural diagram of FIG. 3 in another angle.
Figure 5:
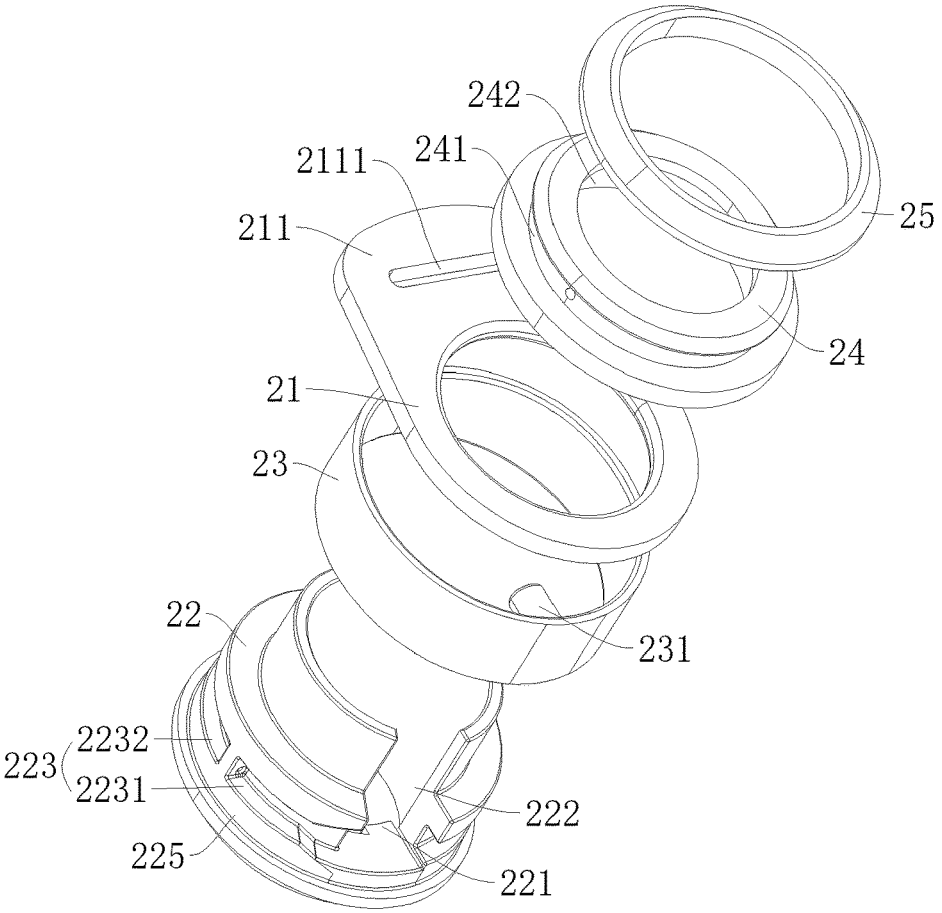
FIG. 5 is an structural exploded diagram of FIG. 4.

Referring to FIG. 5 and in combination with FIG. 3 and FIG. 4, the pull rope connecting device 2 includes a main body 22, a rotating ring 23, and an elastic member (not shown). The main body 22 is provided with the guide block 221. The rotating ring 23 rotatably sleeves the main body 22, and the positioning column 231 is arranged on the rotating ring 23. A first end of the elastic member is fixed to the main body 22; a second end of the elastic member is fixed to the rotating ring 23; and the elastic member drives the rotating ring 23 to be rotatably plugged into the location hole 12. In the sliding process of the pull rope connecting device 2, when the positioning column 231 is aligned with the location hole 12, the positioning column 231 is automatically plugged into the location hole 12 through the action of elastic member. By rotating the rotating ring 23 in a direction for overcoming an elastic force of the elastic member, it can remove the positioning column 231 from the location hole 12.

The main body 22 is provided with a through hole 222 and a mounting slot 223. The through hole 222 penetrates through the main body 22. The mounting slot 223 is arranged on an outer surface of the main body 22 and is connected to the through hole 222. The rotating ring 23 covers at an outer side of the mounting slot 223, and the positioning column 231 is plugged into the through hole 222. The elastic member is arranged in the mounting slot 223; and the second end of the elastic member is fixed to the positioning column 231. That is, the rotating ring 23 can cover the mounting slot 223 and elastic member, so that the pull rope connecting device 2 looks more aesthetically pleasing.

Figure 6:
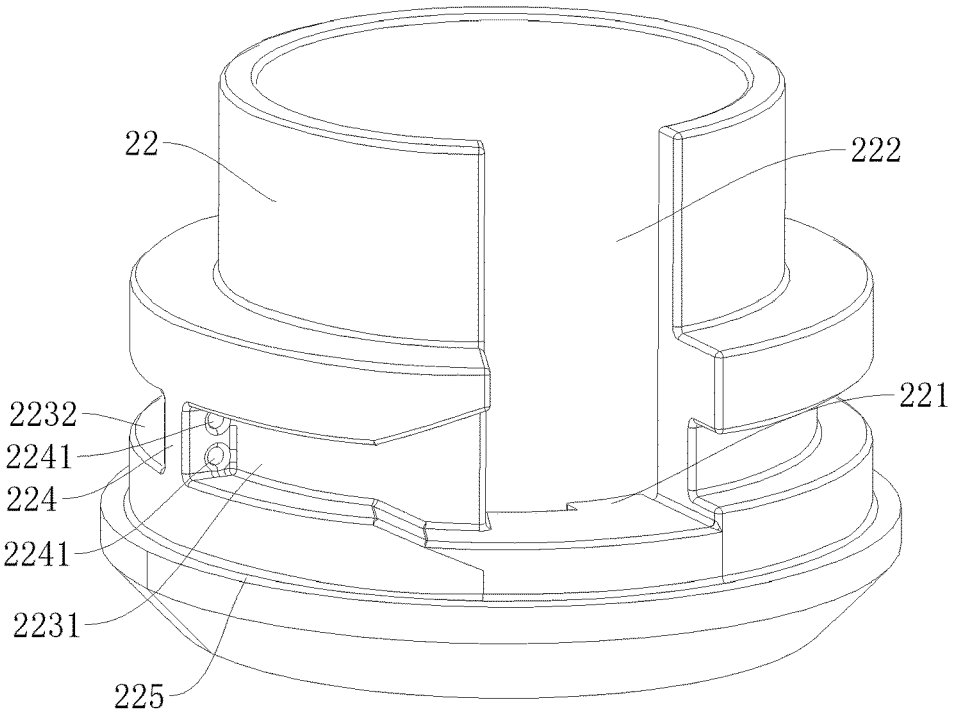
FIG. 6 is a schematic structural diagram of a main body in FIG. 5.

Referring to FIG. 6, a fixed block 224 is also arranged on the main body 22; the fixed block 224 is arranged inside the mounting slot 223, then the mounting slot 223 is divided into a first mounting slot 2231 and a second mounting slot 2232. The fixed block 224 is provided with a perforation 2241; the perforation 2241 penetrates through the fixed block 224 and connects the first mounting slot 2231 with the second mounting slot 2232; the perforation 2241 includes a first perforation 2241 and a second perforation 2241. The elastic member is an elastic ring; the first end of the elastic ring is arranged in the first perforation 2241 and the second perforation 2241 in a penetrating manner; and the second end of the elastic ring sleeves the positioning column 231. The elastic ring can be an elastic rope. The elastic rope is arranged in the first perforation 2241 and the second perforation 2241 in the penetrating manner, and is knotted in the second mounting slot 2232 to form a ring. Then, the ringlike elastic rope sleeves the positioning column 231. In other embodiments, the elastic member can also be a spring. The first end of the spring is fixed to the main body 22, and the second end of the spring is fixed to the positioning column 231. Of course, the second end of the elastic member can also be fixed to another position of the rotating ring 23 except the positioning column 231.

Figure 7:
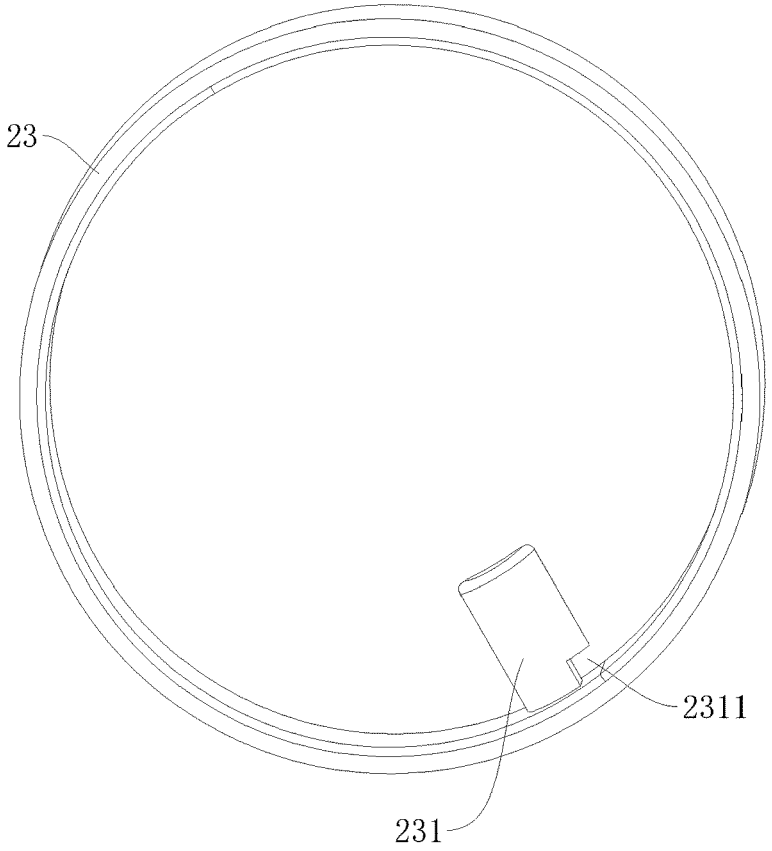
FIG. 7 is a schematic structural diagram of a rotating ring in FIG. 5.

Referring to FIG. 7, a notch 2311 is arranged on the positioning column 231; and the second end of the elastic ring is embedded into the notch 2311. The notch 2311 prevents the elastic ring from being separated from the positioning column 231, which ensures that the position of the elastic ring sleeves the positioning column 231 stably.

Referring to FIG. 5 and in combination with FIG. 3 and FIG. 4, the pull rope connecting device 2 further includes a connecting ring 21 and a retaining ring 24. The main body 22 is further provided with a step ring 225, and the step ring 225 is arranged on the outer surface of the main body 22. The rotating ring 23 is arranged on one side of the step ring 225; the connecting ring 21 rotatably sleeves the main body 22 and is arranged on the side of the rotating ring 23 which faces away from the step ring 225; the connecting ring 21 is provided with the connecting part 2111; the retaining ring 24 sleeves the main body 22 and is arranged on the side of the connecting ring 21 which faces away from the rotating ring 23; and the retaining ring 24 is fixedly connected to the main body 22. The retaining ring 24 prevents the rotating ring 23 and the connecting ring 21 from being separated from the main body 22. The connecting ring 21 can rotate, so that the pull rope connected to the connecting ring 21 has a degree off freedom of rotation, making it convenient for use of the fitness accessory.

The connecting ring 21 has an extension part 211 that extends outwards, and the connecting part 2111 is arranged on the extension part 211. The connecting part 2111 is a connecting hole that penetrates through the extension part 211. In other embodiments, the connecting part 2111 can also be a pull ring, a rope belt, or the like that can be used to connect to the pull rope.

One end of the through hole 222 has an opening, and the retaining ring 24 is provided with a limiting strip 242. The limiting strip 242 is plugged into the through hole 222 through the opening of the through hole 222, and the positioning column 231 is limited between the limiting strip 242 and a bottom surface of the other end of the through hole 222.

The retaining ring 24 is provided with a connecting slot 241. A bottom surface of the connecting slot 241 is provided with a first lock hole, and the main body 22 is provided with a second lock hole. A connector is arranged in the first lock hole and the second lock hole in a penetrating manner to achieve fixed connection between the retaining ring 24 and the main body 22. The connector includes but is not limited to a screw. The pull rope connecting device 2 further includes a decorative ring 25 which sleeves the retaining ring 24 and is folded on an outer side of the connecting slot 241. The decorative ring 25 can cover the first lock hole, the second lock hole, and the connector, so that the pull rope connecting device 2 looks more aesthetically pleasing.

Although the present disclosure has been described with reference to several typical implementations, it should be understood that the terms used are illustrative and exemplary rather than restrictive. Since the present disclosure can be implemented in various forms without departing from the spirit or essence of the present disclosure, it should be understood that the above implementations are not limited to any of the aforementioned details, but should be widely interpreted within the spirit and scope limited by the accompanying claims. Therefore, all changes and modifications falling within the scope of the claims or their equivalent scope should be covered by the accompanying claims.

What is claimed is:

1. A pull rope connecting device, wherein the pull rope connecting device is configured to slidably sleeve a pull bar; the pull bar is provided with a guide slot and a plurality of location holes such that the guide slot and the location holes are connected; the plurality of location holes are arranged at intervals in an extension direction of the guide slot; the pull rope connecting device is provided with a connecting part, a guide block, and a positioning column; the connecting part is configured to be connected to a pull rope; the guide block is slidably plugged into the guide slot to limit rotation of the pull rope connecting device relative to the pull bar; the positioning column is movably arranged; and the positioning column can be plugged into or removed from the location holes.

2. The pull rope connecting device according to claim 1, wherein the location holes extend in a circumferential direction of the pull bar; and the positioning column is rotatably arranged.

3. The pull rope connecting device according to claim 2, wherein the pull rope connecting device comprises a main body, a rotating ring, and an elastic member;

the main body is provided with the guide block;

the rotating ring rotatably sleeves the main body, and the positioning column is arranged on the rotating ring;

a first end of the elastic member is fixed to the main body; a second end of the elastic member is fixed to the rotating ring; and the elastic member drives the rotating ring to be rotatably plugged into the location hole.

4. The pull rope connecting device according to claim 3, wherein the main body is provided with a through hole and a mounting slot; the through hole penetrates through the main body; the mounting slot is arranged on an outer surface of the main body and is connected to the through hole;

the rotating ring covers at an outer side of the mounting slot, and the positioning column is plugged into the through hole;

the elastic member is arranged in the mounting slot, and the second end of the elastic member is fixed to the positioning column.

5. The pull rope connecting device according to claim 4, wherein a fixed block is also arranged on the main body;

the fixed block is arranged inside the mounting slot, then the mounting slot is divided into a first mounting slot and a second mounting slot;

the fixed block is provided with a perforation; the perforation penetrates through the fixed block and connects the first mounting slot with the second mounting slot; the perforation comprises a first perforation and a second perforation;

the elastic member is an elastic ring; the first end of the elastic ring is arranged in the first perforation and the second perforation in a penetrating manner; and the second end of the elastic ring sleeves the positioning column.

6. The pull rope connecting device according to claim 5, wherein a notch is arranged on the positioning column; and the second end of the elastic ring is embedded into the notch.

7. The pull rope connecting device according to claim 4, wherein the pull rope connecting device further comprises a connecting ring and a retaining ring;

the main body is further provided with a step ring; the step ring is arranged on the outer surface of the main body;

the rotating ring is arranged on one side of the step ring;

the connecting ring rotatably sleeves the main body and is arranged on the side of the rotating ring which faces away from the step ring; the connecting ring is provided with the connecting part;

the retaining ring sleeves the main body and is arranged on the side of the connecting ring which faces away from the rotating ring; and the retaining ring is fixedly connected to the main body.

8. A fitness accessory, comprising:

a pull bar, being provided with a guide slot and a plurality of location holes such that the guide slot and the location holes are connected, wherein the plurality of location holes are arranged at intervals in an extension direction of the guide slot;

a pull rope connecting device, slidably sleeving the pull bar, wherein the pull rope connecting device is provided with a connecting part, a guide block, and a positioning column; the connecting part is configured to be connected to a pull rope; the guide block is slidably plugged into the guide slot; the positioning column is movably arranged; and the positioning column can be plugged into or removed from the location holes.

9. The fitness accessory according to claim 8, wherein a region, which is provided with the guide slot and the location holes on the pull bar is an adjustment region;

the pull bar further comprises two adjustment regions, and the two adjustment regions are respectively located at two ends of the pull bar;

the fitness accessory further comprises two pull rope connecting devices which slidably sleeve the two adjustment regions respectively.

10. The fitness accessory according to claim 8, wherein the guide slot is linear and extends in an axial direction of the pull bar.

* * * * *